United States Patent [19]

Barton

[11] 4,214,447

[45] Jul. 29, 1980

[54] DUAL-CRANK STIRLING ENGINE WITH QUAD CYLINDER ARRANGEMENT

[75] Inventor: David W. Barton, Birmingham, Mich.

[73] Assignee: Ford Motor Company, Dearborn, Mich.

[21] Appl. No.: 906,812

[22] Filed: May 17, 1978

[51] Int. Cl.[2] ..... F02G 1/04

[52] U.S. Cl. ..... 60/525

[58] Field of Search ..... 60/517, 526, 525

[56] References Cited

U.S. PATENT DOCUMENTS

| | | | |
|---|---|---|---|
| 2,616,245 | 11/1952 | Van Weenen | 60/525 |
| 3,802,198 | 4/1974 | Grossman et al. | 60/525 |
| 4,016,720 | 4/1977 | Meijer | 60/525 X |

OTHER PUBLICATIONS

United Stirling Publication, printed Jul. 1977.

*Primary Examiner*—Allen M. Ostrager

*Attorney, Agent, or Firm*—Joseph W. Malleck; Keith L. Zerschling

[57] ABSTRACT

An improved multicylinder Stirling engine is disclosed. A dual crank drive is provided in place of the conventional swash plate drive. The use of a dual crank creates a more compact engine as well as other benefits which arise when the engine is used as an automotive prime mover.

5 Claims, 4 Drawing Figures

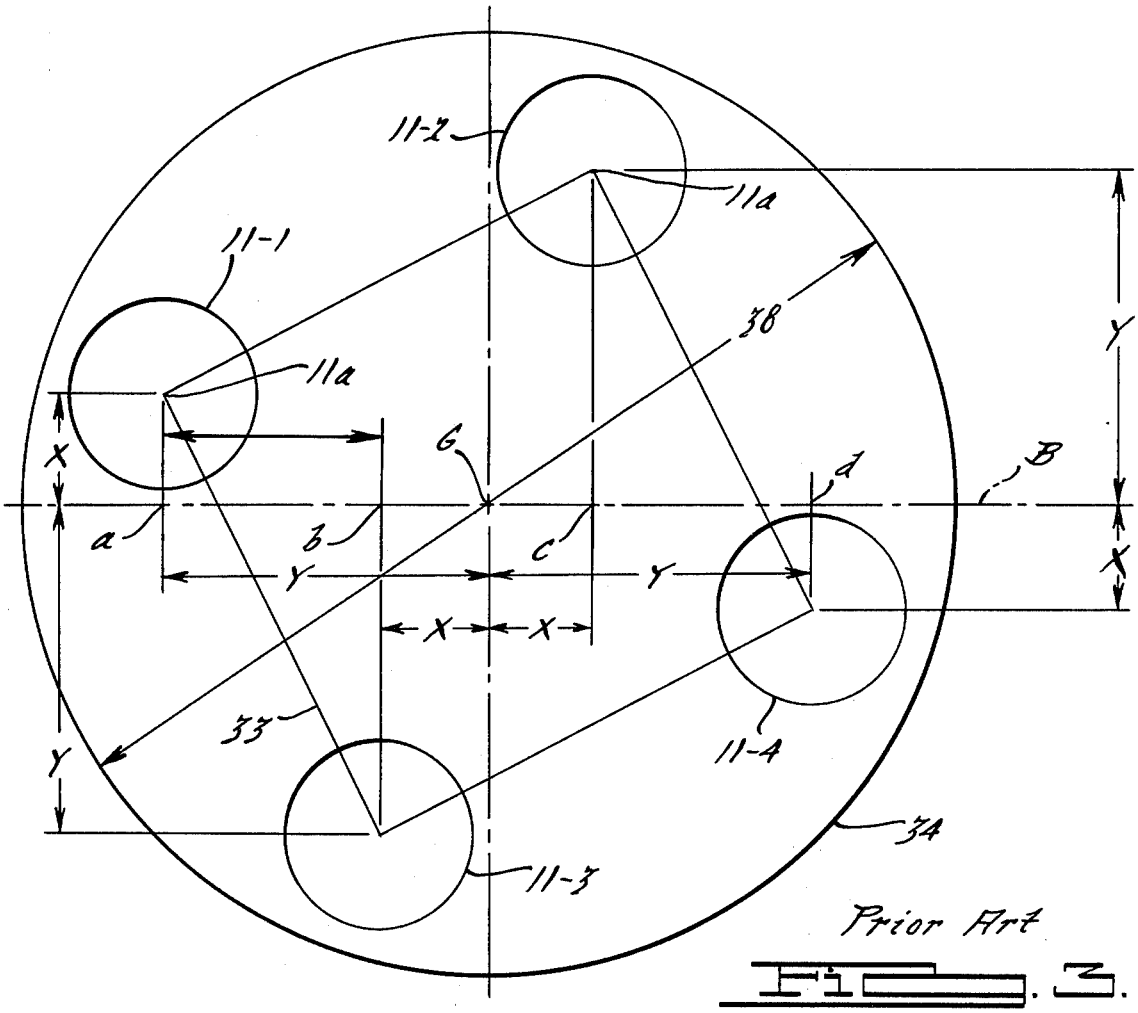
Prior Art
FIG. 3.
FIG. 4.
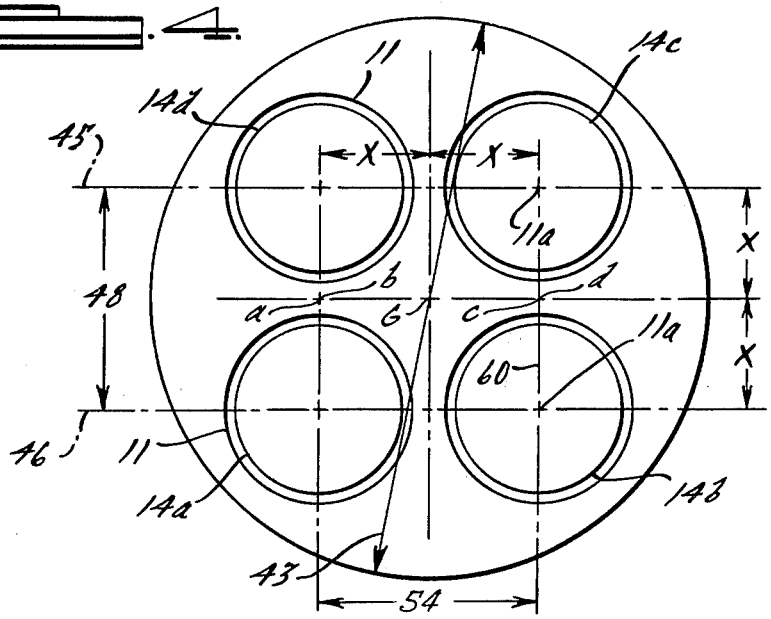

DUAL-CRANK STIRLING ENGINE WITH QUAD CYLINDER ARRANGEMENT

BACKGROUND OF THE INVENTION

The development of drive mechanisms for the Stirling engine in automotive use has followed the evolutionary development of the piston and cylinder assembly. The earliest piston and cylinder arrangement is known as a piston and displacer combination, each operating as a separate reciprocating element either within a common cylinder or within adjacent cylinders for thermal cycling gases therebetween. Single crank drive mechanisms were employed with such early piston-displacer arrangements; however it was not until the development of the rhombic drive that this piston-displacer arrangement became successful for automotive use. The most important contribution of the rhombic drive was the ability to provide for complete balancing, a feature not easily attainable in a machine with a crank-connecting rod mechanism and having separate piston and displacer elements.

With the need for greater engine efficiency, the double acting piston system was developed (sometimes referred to as the Rinia arrangement) whereby the displacer elements were eliminated; one side of each piston would provide a displacing function and the other side of the piston would serve as the conventional piston. In this manner each piston would operate during a complete cycle as both displacer and power piston. This required, of course, the connection of the upper expansion space of each cylinder to the lower compression space of the adjacent cylinder by means of a passage containing the heater, regenerator and cooler.

The invention herein is concerned with Stirling engines of the double acting piston cylinder arrangement. Two drive mechanisms have been utilized with the double acting piston arrangement. The first and earliest was that of the single crankshaft with suitable cranking arms interconnecting the pistons and the crankshaft. In some cases, the cylinders were arranged in an in-line configuration, but this required several heater head assemblies which additionally required a complex fuel control system. In others, the pistons and cylinders were been arranged in a V-configuration with the crank arms or connecting rods interconnecting with the single crankshaft; this demanded that the cylinders be spaced equal distances along the single crankshaft which also dictated a relatively wide spacing between the upper ends of the cylinders. Such wide spacing prevented a compact diametrical configuration for the engine heater head and severely inhibited the use of such design within an automotive packaging environment.

The second type of drive mechanism utilized with the double-acting pistons is that of the swash plate. This drive mechanism typically requires a cluster of pistons with their piston rods extending generally parallel to the output shaft, the piston rods connect with a cross-head mechanism which in turn contact a swash plate or wobble plate which tilts and rotates to convert the reciprocal movement of the piston rods to a rotary output motion. The rotary output motion is imparted to a central output shaft connected thereto. Unfortunately, the output shaft is in line with the piston rods and thus adds to the overall engine length. This is in opposition to the natural transverse direction of the output shaft in a crank engine.

SUMMARY OF THE INVENTION

A primary object of this invention is to provide an improved drive system for a Stirling type engine employing double acting pistons, which system results in considerable compactness of the overall engine configuration both in its diametrical dimension as well as its longitudinal dimension and provides improved heat transfer within the heater head assembly of such engine.

Yet another object of this invention is to provide a drive mechanism for a Stirling type engine utilizing double-acting pistons, which drive mechanism facilitates a variety of power take-off locations and provides for improved balancing of the engine crankshafts.

Still another object of this invention is to provide a drive mechanism for a Stirling engine of the double-acting piston type, which permits the engine to be designed with either integral or separate crossheads thereby making the engine design more flexible.

Specific features pursuant to the above objects comprise (a) the use of dual crankshafts for the drive system, the cylinders and pistons being arranged in a very compact cluster with the spacing between the connecting rods along any one of the crankshafts being equal to the spacing between the crankshafts, (b) the use of positive, negative, or zero angles included between the axis of the cylinders and a centerline of the heater head, an inverted V-configuration for the heater head is provided when negative angles are employed contributing to a considerably decreased diametrical dimension for the engine, and (c) the use of timing chains or geared synchronization between crank arms on opposite crankshafts to balance forces therebetween and to provide for a common output shaft to meet a variety of space requirements.

SUMMARY OF THE DRAWINGS

FIG. 3 is a geometrical plot of the terminal ends of the cylinders for the engine arrangement of FIG. 1, and showing their relationship to the single crankshaft and the housing configuration encompassing said cylinders; and FIG. 4 is a geometrical plot similar to that in FIG. 3, but representing the geometry of the embodiment of FIG. 2 and providing a direct comparison with the geometry of FIG. 3.

DETAILED DESCRIPTION

Figure 1:
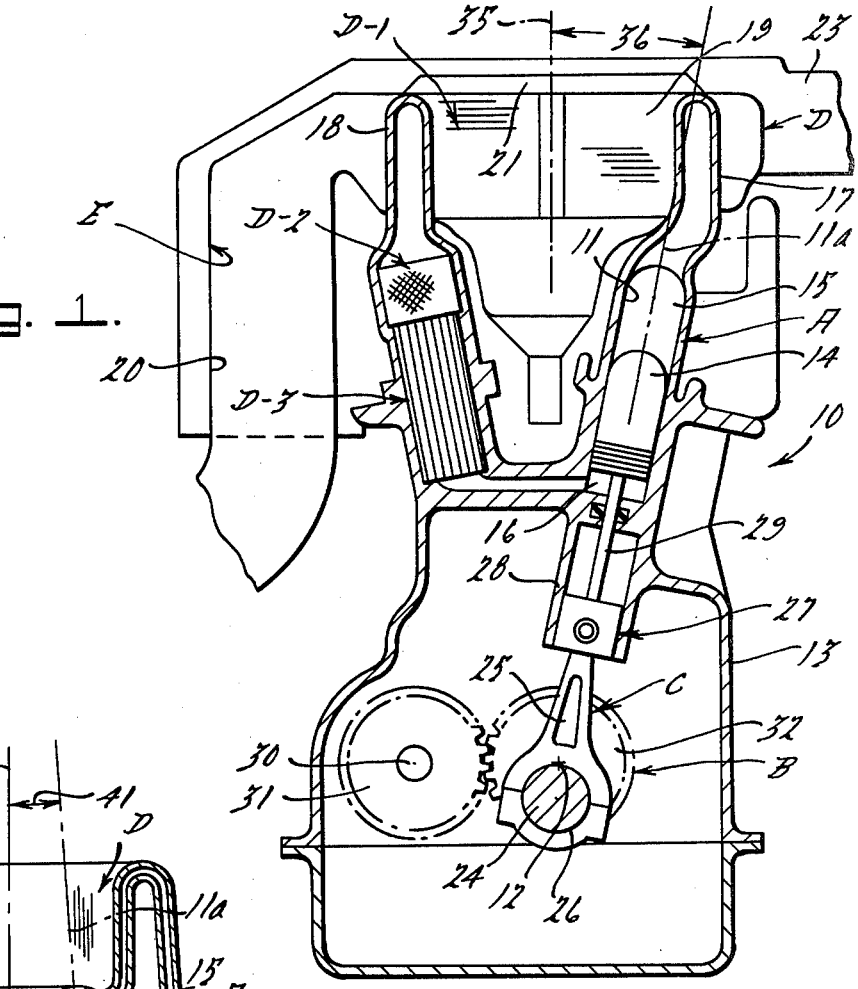
FIG. 1. Prior Art
FIG. 1 is a somewhat schematic illustration, substantially in elevational cross section, of a Stirling engine characteristic of the prior art using a single crankshaft and having each of the piston rods connected with such crankshaft by way of connecting rods spaced at predetermined distances along said single crankshaft.

Turning to FIGS. 1 and 3, a prior art embodiment will be described to indicate certain of the problems that have been solved by the present invention. It is conventional to have the Stirling engine 10 to be comprised essentially of a cylinder and piston assembly A which mechanically drives a single principal crankshaft B through a connecting or drive assembly C enclosed in a crankcase 13. The cylinder and piston assembly is by a thermodynamic cycling assembly D which comprises a heater head D-1, a regenerator D-2, a cooling apparatus D-3; an external heating circuit E transfers heat to the assembly D.

The cylinder and piston assembly A has a plurality of circular cylinders 11 (here four in number) each having a longitudinal axis 11*a* directed to pass through the centerline 12 of the crankshaft B extending transversely through the crankcase housing. The cylinders 11 are arranged in pairs, each pair forming a V-configuration with an included angle therebetween (being considered a positive angle) which is typically in the range of 15° to 25°. The pistons 14 are of the double-acting type and divide the space within the cylinder into two parts, the first part being considered a hot chamber portion 15 and the other part being considered a cool chamber portion 16.

The heater head assembly D-1 is comprised of a hot manifold 17 having a direct communication to the hot chamber 15 of each of the cylinders; the manifold 17 is also connected to another manifold 18 via tubes 19 of the heater head; manifold 18 is in direct communication with regenerator D-2 connected in series to the cooling apparatus D-3, the latter being connected to the cool space 16 of each cylinder. Thermal energy is imparted through the walls of said heater tubes 19 from the external combustion circuit E; said circuit provides for intake of air along a channel 20, addition of fuel and ignition of said mixture in a central region 21 of said heater head assembly, and conveyance of the combusted gases along said heater tubes and thence to atmosphere. For further details of the external combustion circuit see U.S. Pat. No. 3,939,657 which disclosure is incorporated herein by reference.

It is important that the heater assembly D be designed as a unitary system contained in as small a space as possible for improving the packaging flexibility of the engine. Accordingly, the heat transfer tubes 19 are typically arranged in a circular fashion immediately above the cylinders with the mechanism for combusting the gases located centrally thereof and requiring only a single source of fuel. The size of housing 23 surrounding said heater tubes determines a critical engine dimension, namely the transverse dimension of the engine assembly.

The drive assembly C comprises a single crankshaft with a plurality of offset portions 24 defining cranking arms to which a connecting rod 25 is attached about a bearing surface 26 for each crank arm. The connecting rod typically has a length dimension of no greater than the piston rod. The rod 25 connects with a crosshead section 27 slidable within a cylindrical section 28 of the crank case housing 13; section 28 being coaxial with a cylinder 11 and receives a piston rod 29 for reciprocation therein. A counter shaft 30 may be employed for balance and is driven by gear 31 coupled to gear 32 on shaft B; the counter shaft also provides for connecting assessory take off devices thereto. Because of the fixed position of the principal crankshaft B, the power take off from such shaft is extremely limited as to location.

One of the most important aspects of the single crankshaft Stirling engine is that the upper extremities of the cylinders 11 are arranged in a quad configuration so their axes 11*a* lie at the corners of a square 33 and fit equi-distantly within and along a circle 34. (See FIG. 3). The circular arrangement is mandatory to achieve an even distribution of heat to each of the cylinders. Since the axes of each of the cylinders must pass through crankshaft B, the cylinders must be canted outwardly from a centerline 35 of the engine in a positive angle 36, as shown in FIG. 1, to achieve said predetermined spacing along the circular confinement. Not only must the cylinders be arranged as a quad, but each of the connecting rods must attach to the crankshaft at special locations to prevent interference. In FIG. 3, cylinders 11-3 and 11-2 are spaced a distance "X" along the crank axis B from the heater head center G. Cylinders 11-1 and 11-4 are spaced a distance "Y" where "Y" is greater than "X" because each connecting rod must have an individual crank throw. To achieve radial symmetry of the heater head, cylinders 11-1 and 11-4 must be located a distance "X" perpendicular to the crank axis B and cylinders 11-3 and 11-2 a distance "Y" perpendicular to the crank axis B. The points of connection of the crank arms (a,b,c,d) with the crank axis B will not be spaced apart equal distances. The result of these two restrictions dictate unequal angles 36, otherwise the encompassing perimeter 34 will be excessively large. The actual heater head diameter can be greater or smaller than the diameter 38 as shown, but the latter illustrates the general magnitude of the engine and/or heater head size problem. Reducing the V-angle (36) would create several problems: the cylinders would be out of alignment lacking equal distances and thus not form a quad, permitting distortion from unequal temperature distribution.

Figure 2:
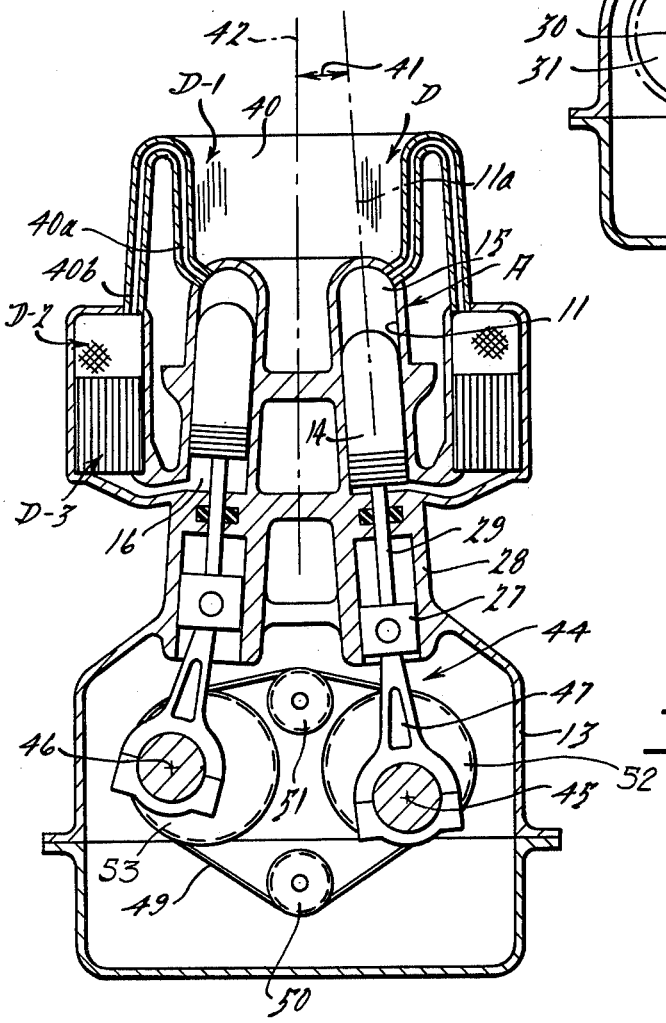
FIG. 2 is a schematic elevational sectional view similar to FIG. 1, but illustrating the Stirling engine embodying the principles of this invention.

Turning now to FIGS. 2 and 4, the preferred embodiment for this invention illustrates a Stirling engine having some portions thereof similar to that in FIGS. 1 and 3. The cylinder and piston assembly A again employs four double-acting pistons 14; each piston 14 and cylinder 11 combination define a hot chamber 15 and a cool chamber 16.

A heater tube assembly D-1 contains a labyrinth of heat transfer tubes 40 each arranged in torodial configuration with one end 40*a* communicating with a hot chamber and an opposite end 40*b* communicating with the in-series connection of the regenerator D-2, cooling apparatus D-3, and cool chamber 16. The usual external combustion circuit is employed, such as that in FIG. 2, employing a channel for carrying intake air to the central portion within the heater head assembly for mixing with fuel; combusted gases are then passed between said heater tubes 40 and carried to exhaust.

Principal differences of this embodiment comprise (a) inclination of the centerlines 11*a* of each of the cylinders 11 to form a negative angle 41 with respect to a central plane 42 bisecting the engine and being parallel to a crankshaft (compactness can also be achieved with zero angles), (b) forming the outer diametrical limits of the heater tube assembly D-1 within a smaller diameter 43 (see FIG. 4), (c) employing a totally different drive mechanism 44 which has dual crankshafts 45 and 46, each connected with the piston rods 29 by a single crank arm or connecting rod 47, the cylinder upper extremities being arranged in a quad or square with one pair of pistons 14*a* and 14*b* being connected to one crankshaft 46 and the other pair of pistons 14*c* and 14*d* being connected to the other crankshaft 45. The spacing 54 between the connections to a single crankshaft, in FIG. 4, is equal to the spacing 48 between the crankshafts 45–46. All the cylinders 11 can be spaced a distance "X" along the crankshaft axes 45 and 46 from the heater head center G. To achieve radial symmetry of the heater head, all cylinders must be located a distance "X" perpendicular to the crankshaft axis away from the heater head center. Although the crankshaft axes 45 and 46 are shown spaced the same distance "X" away from the heater head center, this is not necessarily a design limitation but is preferred. Because "Y" distance in FIG. 3 is greater than the "X" distance, the encompassing diameter 43 of the two-crankshaft quad-cylinder is more compact than the single-crankshaft V-cylinder.

The wide stance of the two crankshafts permits the angle 41 between the cylinder axis 11*a* and the engine center to plane 42 to vary from positive (as in the V-configuration of FIG. 1) to zero or as shown in FIG. 3 to be negative. This facilitates an extremely compact heater head whereby the diameter 43 (shown in FIG. 4) can be reduced substantially from the diameter 38 (in FIG. 3) by the order of almost 2, while permitting the crank arm connections in FIG. 4 to be spaced apart substantially of the same order as in FIG. 3.

In the prior art embodiment of FIG. 1, a second countershaft is typically used and is geared to the principal crankshaft; however, in the preferred embodiment of FIGS. 2 and 4, the dual crankshafts 45–46 are synchronized together by way of a timing chain 49 connected to gears 52–53 on said respective shafts. This not only provides for superior balance of the crankshafts, but also permits three optional locations for the output shaft by use of idler sprockets 50–51. The added flexibility can be most useful in difficult packaging situations such as in a front wheel drive application of the Stirling engine in automotive use.

In the embodiment of FIG. 3, the wide stance of the two crankshafts 45–46 permits the center 11*a* of the upper extremities of the cylinders 11 to be in the same plane perpendicular to the crankshaft axis and thereby be nested quite close together. Most critical is the fact that the spacing 49 between connecting rod 47 connections (about bearing surface 26) to a single crankshaft can be equal to the spacing 48 between the crankshafts themselves. As a result, the encompassing diameter 43 of the dual-crankshaft quad-cylinder is much more compact than the single crankshaft V-cylinder arrangement of FIG. 1. The embodiment of FIG. 4 essentially reduces the diametrical as well as the longitudinal dimension of a Stirling engine to accommodate a front wheel drive application where the engine must be turned sideways; it also is useful in other applications, such as rear wheel drive without interrupting the interior space design of the vehicle. Longitudinal compactness results from the use of crank arms (connecting rods) which permit the output shaft to be automatically arranged transverse to the axes of the pistons. Diametrical compactness results from the close nesting of the upper extremities of the cylinders to permit restriction of the heater tube assembly to a tighter geometrical area.

In opposition, the prior art (as presented in FIGS. 1 and 3) can only achieve longitudinal compactness, but cannot achieve diametrical compactness because of the wide spacing or stance of the upper extremities of the cylinders to achieve proper drive connection between the pistons and the single crankshaft. A Stirling engine designed with a swash plate drive mechanism, although having generally a zero angle between the cylinder axes and the engine centerline, does achieve some degree of compactness of the heater head assembly. However, a swash plate drive engine loses considerably in longitudinal compactness because the output shaft of the swash plate drive mechanism is coaxial or in-line with the direction of the piston reciprocation and therefore some additional mechanism must be provided to turn the output movement in a transverse direction. Such additional mechanism, of course, adds to the length of the engine, as well as cost.

In summary, the differences over the swash plate drive that occur in the output drive and assessory drive include:

- The dual crank output axis is at right angle to the piston axis while the swash plate output axis is parallel with the piston axis.
- The dual crank output may be geared up or down in speed and its location can be varied.
- The swash plate output has no inherent speed change flexibility and its location is fixed.
- The dual crank permits assessory drives from either or both ends of the crankcase while the swash plate take-off locations are limited.

I claim as my invention:

1. In a Stirling engine having a reciprocating apparatus consisting of a crankcase, a plurality of cylinders adjacent said crankcase, double-acting pistons in each of said cylinders, each piston having a piston rod extending into said crankcase, a crankshaft means within said crankcase, crank arm means drivingly connecting each of said piston rods with said crankshaft means, thermodynamic cycling means for said pistons, the improvement comprising:

(a) said crankshaft means having at least one pair of spaced parallel arranged crankshafts, (b) said cylinders being four in number and having the upper extremities of said cylinders spaced equidistantly in a quad-cluster about a central engine axis transverse to said crankshafts, the longitudinal extent of all of the cylinders forming zero or negative angles with respect to said central engine axis.

2. The Stirling engine as in claim 1 in which each of said crankshafts are disposed at opposite sides of a plane passing through said central engine axis, said cylinders being arranged in pairs associated with each of said crankshafts respectively, the pistons in one pair of said cylinders being connected to one of said crankshafts by way of one pair of crank arms, and the other pistons in the other of said pairs of cylinders being connected to the other crankshaft by still another pair of crank arms, the spacing between the connections of said crank arms to either of said crankshafts being equal to the spacing between the crankshafts.

3. The Stirling engine as in claim 1, in which idler sprockets are disposed between said crankshafts providing an output member therefrom, a timing chain drivingly connected to each crankshaft for synchronization of rotary movement of said crankshafts with said idler sprockets.

4. The Stirling engine as in claim 3, in which means are provided for alternatively taking output power from said idler sprocket or said crankshafts.

5. The Stirling engine as in claim 2, further comprising a housing entraining said heater head assembly the radius of which is no greater than 1.3 times the spacing between the crank arm connections to a single crankshaft.

* * * * *